US009618011B2

(12) United States Patent
Lee

(10) Patent No.: US 9,618,011 B2
(45) Date of Patent: Apr. 11, 2017

(54) ELECTRIC WATER PUMP WITH COOLANT PASSAGE

(71) Applicants: HYUNDAI MOTOR COMPANY, Seoul (KR); Kia Motors Corporation, Seoul (KR)

(72) Inventor: Bong Sang Lee, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 193 days.

(21) Appl. No.: 14/556,285

(22) Filed: Dec. 1, 2014

(65) Prior Publication Data

US 2016/0061221 A1 Mar. 3, 2016

(30) Foreign Application Priority Data

Aug. 27, 2014 (KR) ..... 10-2014-0112626

(51) Int. Cl.
*F04D 29/58* (2006.01)
*F04D 13/06* (2006.01)

(52) U.S. Cl.
CPC ..... *F04D 29/5806* (2013.01); *F04D 13/0686* (2013.01); *F04D 29/588* (2013.01); *F04D 29/5813* (2013.01)

(58) Field of Classification Search
CPC ..... F04D 13/064; F04D 13/0606; F04D 13/0626; F04D 29/586; F04D 29/588; F04D 29/5813; F04D 29/5806
USPC .. 417/369, 370, 423.3, 423.7, 423.8, 423.14
See application file for complete search history.

(56) References Cited

U.S. PATENT DOCUMENTS 2,925,041 A * 2/1960 Sigmund ..... F04D 15/0094 310/63
5,480,290 A * 1/1996 Zelder ..... F04D 13/086 417/366
5,890,880 A * 4/1999 Lustwerk ..... F04D 29/588 415/171.1
5,930,852 A * 8/1999 Gravatt ..... F04D 13/06 4/493
5,997,261 A * 12/1999 Kershaw ..... F04D 29/588 310/54
6,986,648 B2 * 1/2006 Williams ..... F04D 13/064 417/370

FOREIGN PATENT DOCUMENTS

JP 2008-025455 A 2/2008
JP 4621065 B2 1/2011
KR 1995-0003639 A 2/1995
KR 10-1072328 B1 10/2011
KR 10-1332853 B1 11/2013

* cited by examiner

*Primary Examiner* — Peter J Bertheaud
(74) *Attorney, Agent, or Firm* — McDermott Will & Emery LLP

(57) ABSTRACT

An electric water pump includes an electric motor having a stator which generates an electromagnetic field by control signals supplied from a driver and a rotor which rotates by the electromagnetic field generated by the stator. An impeller is connected to and rotates with the rotor to circulate a coolant. An inside space of the electric water pump may include a motor room in which the electric motor is disposed, a volute room in which the impeller is positioned, and a pump driver room in which the pump driver is positioned.

8 Claims, 3 Drawing Sheets

ELECTRIC WATER PUMP WITH COOLANT PASSAGE

CROSS-REFERENCE TO RELATED APPLICATION

The present application claims the benefit of priority to Korean Patent Application Number 10-2014-0112626 filed on Aug. 27, 2014, the entire contents of which application are incorporated herein for all purposes by this reference.

TECHNICAL FIELD

The present disclosure relates to an electric water pump, and more particularly, to an electric water pump having a separate coolant flow passage therein.

BACKGROUND

A water pump for a vehicle circulates a coolant through an engine, a heater, etc. for cooling the engine and heating an inside of the vehicle. The coolant in the water pump recirculates after discharged from the water pump and exchanging heat with the engine, the heater, a radiator, or the like.

The water pump is classified into a mechanical water pump and an electric water pump.

The mechanical water pump operates according to rotation of a crankshaft, i.e., rotation of an engine revolutions per minute (RPM) by being connected with a pulley fixed to the crankshaft of the engine. Therefore, a flow rate of the coolant discharged from the mechanical water pump is determined according to the engine RPM.

Here, the flow rate of the coolant necessary for the heater, the radiator, etc. is determined without relation to the engine RPM. In a low engine speed region, since the heater and the radiator cannot operate normally, the engine speed needs to be increased for a normal operation of the heater and the radiator, thus increasing fuel consumption.

The electric water pump operates by a motor controlled through a controller. Therefore, the electric water pump can determine the flow rate of the coolant, regardless of the engine RPM.

However, waterproof function is required for components used in an electric water pump to improve performance and durability of the electric water pump.

The demand for the electric water pump has been increasing. Accordingly, technologies for improving performance and durability of the electric water pump have been developing.

The electric water pump requires a separate pump driver to control an electric motor, and the pump driver is assembled integrally with the electric water pump as a printed circuit board (PCB) in which electrical elements of a microprocessor, a condenser, a resistor, a switch, etc. are integrated.

The PCB is mounted in a pump driver room which is formed at a rear or side portion of the electric water pump. The pump driver room is prevented from water flowing therein by having a sealed structure.

In general, when there is a high load during driving due to a high load of the electric motor, temperature of the PCB also increases.

In addition, since high temperature of about 150 degrees centigrade is maintained in a periphery of the engine on which the electric water pump is mounted, temperature of the pump driver room and the PCB of the electric water pump is high.

The above information disclosed in this Background section is only for enhancement of understanding of the background of the invention, and therefore, it may contain information that does not form the prior art that is already known in this country to a person of ordinary skill in the art.

SUMMARY

An aspects of the present inventive concept provides a cooling structure of an electric water pump capable of increasing heat release efficiency of a pump driver and a pump driver room by forming a coolant flow passage in a bulkhead mounted between a motor room and the pump driver room of the electric water pump and running coolant through the coolant flow passage.

According to an exemplary embodiment the present inventive concept, an electric water pump includes an electric motor having a stator which generates an electromagnetic field by control signals supplied from a pump driver and a rotor which rotates by the electromagnetic field generated by the stator. An impeller is connected to and rotates with the rotor to circulate a coolant. An inside space of the electric water pump may include a motor room in which the electric motor is disposed, a volute room in which the impeller is disposed, and a pump driver room in which the pump driver is disposed. The electric water pump may further comprise a first cooling passage formed in one side of a water pump housing or a motor room cover for sealing the motor room from outside. A second cooling passage has one end connected to the first cooling passage and penetrates the bulkhead and the cap room. A third cooling passage is connected to another end of the second cooling passage and formed in another side of the water pump housing or the motor room cover. A portion of the coolant passing through the volute room flows through the first cooling passage, one part of the second cooling passage, the cap room, another part of the second cooling passage, and the third cooling passage.

The electric water pump may further include an insulation pad insulating the pump driver from the bulkhead.

A front side of the rotor room may fluidly communicate with the volute room such that the coolant flows into the rotor room.

The cap room may be formed in a thickness direction of the bulkhead before mounting the cap, and a cross-section of the cap room perpendicular to a thickness direction of the cap room may be identical to that of the cap.

The first cooling passage and the third cooling passage may be formed in a length direction of the electric water pump, and the second cooling passage may pass through a middle of the bulkhead or the cap room.

At least one coolant flow passage may be integrally formed by the first cooling passage, the second cooling passage, and the third cooling passage.

DETAILED DESCRIPTION

Reference will now be made in detail to various embodiments of the present inventive concept, examples of which are illustrated in the accompanying drawings and described below. While the disclosure will be described in conjunction with exemplary embodiments, it will be understood that present description is not intended to limit the inventive concept to those exemplary embodiments. On the contrary, the invention(s) is/are intended to cover not only the exemplary embodiments, but also various alternatives, modifications, equivalents, and other embodiments, which may be included within the spirit and scope of the invention as defined by the appended claims.

In addition, unless explicitly described to the contrary, the word "comprise" and variations such as "comprises" or "comprising" will be understood to imply the inclusion of stated elements but not the exclusion of any other elements, and the name of a component doesn't set limits to the function of the component concerned.

Figure 1:
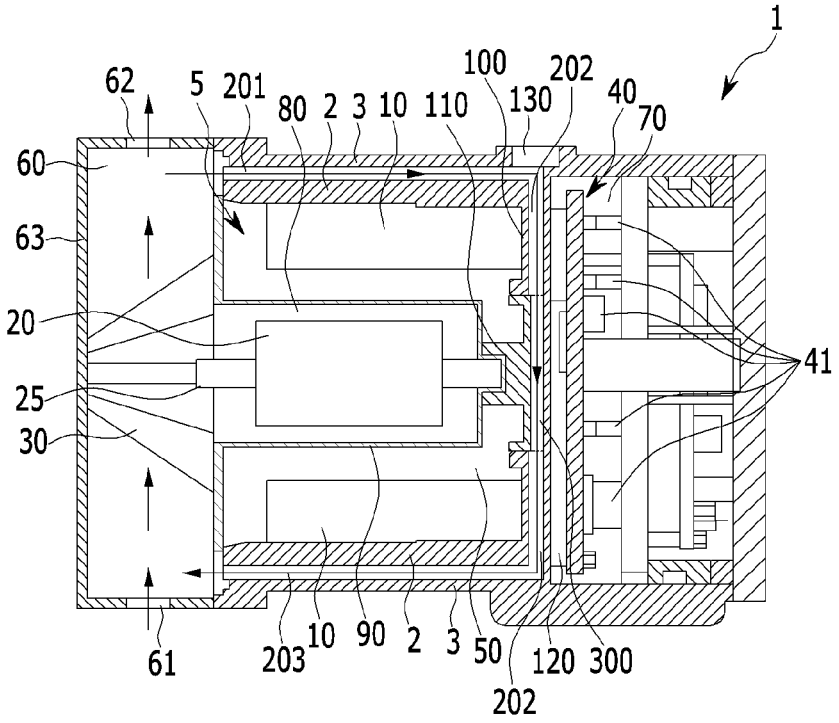
FIG. 1 is a schematic diagram showing a longitudinal section of an electric water pump according to an exemplary embodiment the present inventive concept.

FIG. 1 is a schematic diagram showing a longitudinal section of an electric water pump according to an exemplary embodiment of the present inventive concept.

Referring to FIG. 1, an electric water pump 1 according to an exemplary embodiment of the present inventive concept may comprise an electric motor 5 having a stator 10 which generates an electromagnetic field by control signals supplied from a pump driver 40. A rotor 20 rotates by the electromagnetic field generated by the stator 10. An impeller 30 circulates a coolant by being connected to the rotor 20 and rotates with the rotor 20.

The pump driver 40 is a circuit board in which electrical elements 41 of a microprocessor, a condenser, a resistor, a switch, etc. are integrated, and may be a printed circuit board (PCB).

An inside space of the electric water pump 1 may include a motor room 50 in which the electric motor 5 is disposed, a volute room 60 in which the impeller 30 is disposed, and a pump driver room 70 in which the pump driver 40 is disposed.

An exterior surface of the electric water pump 1 is formed by a water pump housing 3 and a volute room cover 63. The water pump housing 3 and the volute room cover 63 close and seal the motor room 50 and the volute room 60, respectively, from outside of the electric water pump 1.

However, it is not limited thereto that the motor room 50 may be closed and sealed by a separate cover with respect to the external space.

In FIG. 1, a separate motor room cover 2 is used together with the water pump housing 3.

Referring to FIG. 1, the electric water pump 1 according to the present disclosure may further include a separation wall 90 separately forming a rotor room 80 in the motor room 50 such that the rotor 20 is isolated from the motor room 50. A bulkhead 100 separates the motor room 50 from the pump driver room 70 such that the motor room 50 and the pump driver room 70 are closed and sealed with respect to each other by the bulkhead 100. A cap 110 is mounted at a front surface of the bulkhead 100 such that the cap 110 supports one end of the separation wall 90. A cap room 300 is formed in the bulkhead 100 to be closed and sealed with respect to the motor room by the cap 110.

The cap room 300 may be formed in a thickness direction of the bulkhead 100 before mounting the cap 110. The cap room 300 may be formed by a boring process of the bulkhead 100 inside the motor room 50. In this case, the cap room 300 may be a space of a cylindrical or a circular plate shape formed in the thickness direction of the bulkhead 100.

A height of the cylindrical shape (or a thickness of the circular plate shape) of the cap room 300 is smaller than a thickness of the bulkhead 100.

A machining method of the cap room 300 is not limited to the boring process, and any method forming a plate shape having a thickness less than the thickness of the bulkhead 100 can be applied.

The cap 110 needs to be separately made and mounted to block an opening of the motor room 50 toward the cap room 300. The cap 110 may be mounted at an opening of the cap room 300, for an example, by press fitting. The cap room 300 can be a space in which a coolant flows, and water must not enter the motor room 50 to prevent the electric motor 5.

Accordingly, a cross-section of the cap 110 may have a substantially identical shape as that of a cross-section of the cap room 300. These cross-sections may have a circular shape or any other shape according to a machining process for the cap room 300.

A front side of the rotor room 80 may fluidly communicate with the volute room 60 such that the coolant flows into the rotor room 80. However, according to an exemplary embodiment of FIG. 1, the coolant does not flow in the rotor room 80.

The electric water pump 1 may further include an insulation pad 120 for insulating the pump driver 40 from the bulkhead 100.

Referring to FIG. 1, the electric water pump 1 according to the present disclosure may further include a first cooling passage 201 formed in one side of the water pump housing 3 or the motor room cover 2 which seals the motor room 50 from outside. A second cooling passage 202 has one end connected to the first cooling passage 201 and penetrates the bulkhead 100 and the cap room 300. A third cooling passage 203 is connected to another end of the second cooling passage 202 and formed in another side of the water pump housing 3 or the motor room cover 2.

According to an exemplary embodiment of the present inventive concept, the first cooling passage 201 and the third cooling passage 203 are formed in the water pump housing 3 by drilling.

In this case, the bulkhead 100 may be integrally formed in the water pump housing 3, and the second cooling passage 202 may be formed in the bulkhead 100 by drilling to penetrate the cap room 300 and then sealed from outside.

The electric water pump 1 may further include a closing and sealing portion 130 as shown in FIG. 1. The first cooling passage 201, the second cooling passage 202, the cap room 300, and the third cooling passage 203 are connected with one another to form a separate coolant flow passage.

Referring to FIG. 1, an operation of the electric water pump 1 according to the present disclosure and heat transfer paths of the pump driver room will be explained hereinafter.

The volute room 60 is a space in which a coolant flows through an inlet 61 and an outlet 62.

The inlet 61 is generally connected to a radiator side (not shown). Cooled coolant flows into the volute room 60 from a radiator through the inlet 61 when the impeller 30, which is connected to the rotor 20, starts rotating by operation of the electric motor 5.

The outlet 62 is generally connected to a water jacket (not shown) of an engine, and the impeller 30 supplies the coolant flowing into the volute room 60 to the water jacket through the outlet 62 after pressurizing the coolant (arrows in the volute room 60 of FIG. 1 show a flowing direction of the coolant).

A portion of the coolant flowing in the volute room 60 may flow into the rotor room 80 fluidly communicating with the volute room 60. However, according to an exemplary embodiment of FIG. 1, the coolant does not flow in the rotor room 80.

Heat release from the pump driver 40 by the separate coolant flow passage shown in FIG. 1 will be described.

Referring to FIG. 1, the portion of the coolant passing through the volute room 60 may sequentially flow through the first cooling passage 201, one part of the second cooling passage 202, the cap room 300, another part of the second cooling passage 202, and the third cooling passage 203.

The coolant flows into one end of the first cooling passage 201 which is a high pressure portion of the volute room 60, passes through the second cooling passage 202 connected to another end of the first cooling passage 201, and can thereby receive heat generated from the pump driver 40.

The second cooling passage 202 penetrates the cap room 300, the coolant flowing into the cap room 300 can effectively cool a center portion of the pump driver 40 in which heat is generated.

The cap room 300 may be formed at a center portion of the bulkhead 100, but may be formed away from the center portion depending on a position of maximum heat generation of the pump driver 40.

Subsequently, the coolant may flow through another part of the second cooling passage 202, pass the third cooling passage 203, and flow back into a low pressure portion of the volute room 60.

However, in another exemplary embodiment of the present inventive concept, the coolant may flow in an opposite direction depending on a configuration of an electric water pump 1 such as a rotational direction of the impeller 30.

By having the separate coolant flow passage as described above, heat release effect is increased since the heat generated in the pump driver 40 passes only the bulkhead 100 or only the insulation pad 120 and the bulkhead 100 and is transferred to the coolant flowing through the cap room 300.

The first cooling passage 201 and the third cooling passage 203 may be formed in a length direction of the electric water pump 1 for convenience of machining such as drilling for forming the coolant passages.

Although a flow direction of the first cooling passage 201 and the third cooling passage 203 may vary according to a machining process, as long as coolant flows into one end of the coolant flow passage, the coolant can flow out from another end thereof.

The second cooling passage 202 may pass through a middle of the bulkhead 100 or a middle of the cap room 300 since the heat is generated intensively at a center portion of the pump driver 40.

The coolant flow passage integrally formed by the first cooling passage 201, the second cooling passage 202, and the third cooling passage 203 may be more than one, as long as the second cooling passage 202 penetrates the cap room 300. As long as the electric water pump 1 maintains structural-rigidity, the heat release effect of the pump driver 40 and the pump driver room 70 can be improved through the second cooling passage 202 enabled to pass through different portions of the bulkhead 100.

Figure 2:
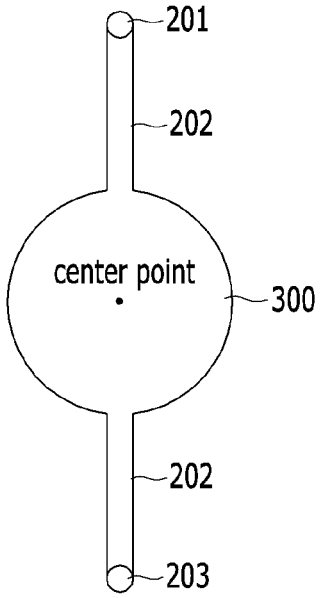
FIG. 2 is a top plan view a coolant flow passage of an electric water pump according to an exemplary embodiment the present inventive concept.

FIG. 2 is a top plan view a coolant flow passage of an electric water pump according to an exemplary embodiment of the present inventive concept.

Figure 3:
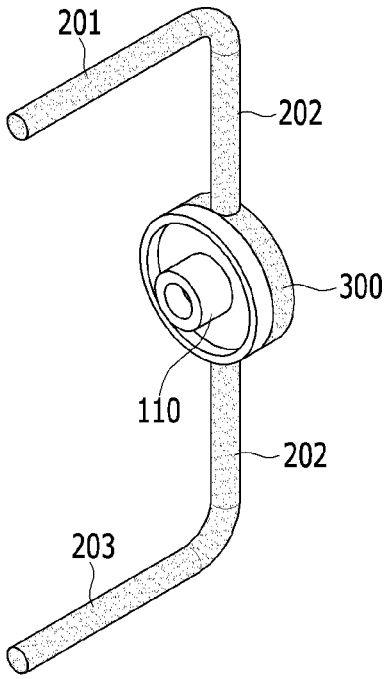
FIG. 3 is a perspective view showing together a cap and a coolant flow passage of an electric water pump according to an exemplary embodiment the present inventive concept.

FIG. 3 is a perspective view showing together a cap and a coolant flow passage of an electric water pump according to the present inventive concept.

In FIG. 2, the second cooling passage 202 according to an exemplary embodiment of the present inventive concept passes through a center point of the cap room 300.

FIG. 3 depicts the coolant flow passage integrally formed by the first cooling passage 201, one part of the second cooling passage 202, the cap room 300, another part of the second cooling passage 202, and the third cooling passage 203 connected with one another.

In this case, the cap 110 shown in FIG. 3 has a cross-section shape identical to that of the cap room 300 to close and seal an opening of a motor room 50.

In addition, the cap 110 has a cylindrical protrusion formed as shown in FIG. 1 such that one end of the separation wall 90 can be supported thereby.

As explained in detail, according to the present disclosure, cooling of a pump driver and a pump driver room of an electric water pump can be effectively achieved.

While this disclosure has been described in connection with what is presently considered to be practical exemplary embodiments, it is to be understood that the inventive concept is not limited to the disclosed embodiments, but on the contrary, is intended to cover various modifications and equivalent arrangements included within the spirit and scope of the appended claims.

What is claimed is:

1. An electric water pump comprising:

an electric motor having a stator which generates an electromagnetic field by control signals supplied from a pump driver, and a rotor which rotates by the electromagnetic field generated by the stator;

an impeller connected to and rotating with the rotor to circulate a coolant, wherein an inside space of the electric water pump includes:

a motor room in which the electric motor is disposed, a volute room in which the impeller is disposed, and a pump driver room in which the pump driver is disposed;

a bulkhead separating the motor room and the pump driver room such that the motor room and the pump driver room are sealed with each other by the bulkhead;

a separation wall separately forming a rotor room in the motor room to isolate the rotor from the stator in the motor room;

a cap mounted at a front surface of the bulkhead to support one end of the separation wall, wherein the cap is separately formed from the bulkhead and fitted to the bulkhead;

a cap room formed in the bulkhead such that the cap room is closed and sealed with respect to the motor room by the cap, wherein the cap room is formed at a side of the cap facing the pump driver room;

a first passage formed in one side of a water pump housing or a motor room cover for sealing the motor room from outside;

a second cooling passage of which one end is connected to the first cooling passage, the second cooling passage penetrating the bulkhead and the cap room; and a third cooling passage connected to another end of the second cooling passage and formed in another side of the water pump housing or the motor room cover, wherein a portion of the coolant passing through the volute room flows through the first cooling passage, one part of the second cooling passage, the cap room, another part of the second cooling passage, and the third cooling passage, wherein the first, second, and third cooling passages are integrally formed by the water pump housing, the bulkhead, and the motor room cover.

2. The electric water pump of claim 1, further comprising an insulation pad insulating the pump driver from the bulkhead.

3. The electric water pump of claim 1, wherein a front side of the rotor room fluidly communicates with the volute room such that coolant flows into the rotor room.

4. The electric water pump of claim 1, wherein the cap room is formed in a thickness direction of the bulkhead before mounting the cap, and a cross-section of the cap room perpendicular to a thickness direction of the cap room is identical to that of the cap.

5. The electric water pump of claim 1, wherein the first cooling passage and the third cooling passage are formed in a length direction of the electric water pump.

6. The electric water pump of claim 5, wherein the second cooling passage passes through a middle of the bulkhead or the cap room.

7. The electric water pump of claim 1, wherein at least one coolant flow passage is integrally formed by the first cooling passage, the second cooling passage, and the third cooling passage.

8. The electric water pump of claim 1, wherein the volute room has an inlet and outlet through which the coolant flows by rotation of the impeller and flows out.

* * * * *